US008365709B2

(12) United States Patent
Usukura et al.

(10) Patent No.: US 8,365,709 B2
(45) Date of Patent: Feb. 5, 2013

(54) REVERSE ROTATION PREVENTIVE DEVICE FOR ENGINE OF MOTORCYCLE

(75) Inventors: Yasutaka Usukura, Saitama (JP); Kenichi Machida, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 421 days.

(21) Appl. No.: 12/796,773

(22) Filed: Jun. 9, 2010

(65) Prior Publication Data

US 2010/0319666 A1 Dec. 23, 2010

(30) Foreign Application Priority Data

Jun. 17, 2009 (JP) ..... 2009-144187

(51) Int. Cl.
*F02P 11/00* (2006.01)

(52) U.S. Cl. ..... 123/631; 123/179.5

(58) Field of Classification Search ..... 123/630, 123/631, 632, 179.28, 179.5
See application file for complete search history.

(56) References Cited

U.S. PATENT DOCUMENTS 4,145,608 A * 3/1979 Shirasaki et al. ..... 250/231.14
6,784,658 B2 * 8/2004 Kawagoe et al. ..... 324/163
7,032,440 B2 * 4/2006 Kishibata et al. ..... 73/114.26
7,171,948 B2 * 2/2007 Shimoyama et al. .... 123/406.57
2004/0107950 A1 6/2004 Masaoka et al.
2005/0120782 A1 * 6/2005 Kishibata et al. ..... 73/116

FOREIGN PATENT DOCUMENTS

JP 3945645 B2 4/2007

* cited by examiner

*Primary Examiner* — John Kwon

(74) *Attorney, Agent, or Firm* — Birch, Stewart, Kolasch & Birch, LLP

(57) ABSTRACT

A reverse rotation preventive device wherein an engine can be restarted without once stopping the vehicle even in the case where a reverse rotation preventive function is operated in response to momentary locking of a rear wheel. A plurality of reluctors are arranged at regular intervals, exclusive of a toothless part at one location with a crank pulse rotor rotated synchronously with a crankshaft of the engine, and a first and second pulse generators each of which outputs a pulse signal corresponding to the interval of the reluctors. Reverse rotation preventive means inhibits ignition of a spark plug by operating the reverse rotation preventive function when the interpulse time of the pulse signal exceeds a predetermined time and cancels the inhibition of the ignition when it is detected that a crankshaft is in normal rotation after the ignition is inhibited by the operation of the reverse rotation preventive function.

20 Claims, 9 Drawing Sheets a: NO. OF RELUCTOR PASSING PC1 b: NO. OF RELUCTOR PASSING PC2 c: CRANKSHAFT REFERENCE POSITION, MADE DEFINITE d: STAGE JUDGEMENT, OK e: REVERSE ROTATION, DETECTED

REVERSE ROTATION PREVENTIVE DEVICE FOR ENGINE OF MOTORCYCLE

CROSS-REFERENCE TO RELATED APPLICATIONS

The present application claims priority under 35 USC 119 to Japanese Patent Application No. 2009-144187 filed on Jun. 17, 2009 the entire contents of which are hereby incorporated by reference.

BACKGROUND OF THE INVENTION

1. Field of the Invention

The present invention relates to a reverse rotation preventive device for an engine of a motorcycle, and particularly to a reverse rotation preventive device for an engine of a motorcycle which is compatible with various operating conditions and is highly convenient to use.

2. Description of Background Art

It is known that when the rotating speed of a crankshaft is insufficient for starting an engine through cranking by use of a kick starter, a phenomenon of "reverse rotation" may occur in which the crankshaft is rotated in the reverse direction due to an explosion force attendant on ignition and the kick pedal is thereby pushed back.

Japanese Patent No. 3945645 discloses a reverse rotation preventive device for an engine in which, when the rotating speed of a crankshaft after its start of rotation is lowered to or below a predetermined value, the ignition at an ignition device is inhibited and the ignition inhibited condition is maintained until a new cranking operation is conducted.

Meanwhile, during the operation of a motorcycle, there is a situation in which even upon momentary locking of the rear wheel due to a braking operation during operation, the braking operation is immediately canceled to thereby continue the operation. In relation to such a situation, in the case of the reverse rotation preventive device for an engine described in Japanese Patent No. 3945645, when the rotating speed of the crankshaft is lowered to or below a predetermined value attendant on the locking of the rear wheel, a reverse rotation preventive function operates to inhibit ignition. Then, even if the brake is released in this condition and the rear wheel is rotated by the inertia of the vehicle body to thereby rotate the crankshaft, it may be impossible to restart the engine because the ignition inhibited condition is maintained. Therefore, when the engine is stopped due to the operation of the reverse rotation preventive function during operation, it is necessary to once stop the vehicle for the purpose of carrying out a new cranking operation.

In addition, particularly in a batteryless vehicle, the application of a system in which a reverse rotation preventive function is canceled by turning off the power supply for an ECU has the following problem. When the rotation of the crankshaft is recovered by releasing the brake immediately after the operation of the reverse rotation preventive function attendant on the locking of the rear wheel, the supply of electric power by a generator is restarted before the ECU voltage is lowered below a predetermined reset voltage. This may results in that the reverse rotation preventive function is not canceled. Thus, the engine cannot be restarted.

SUMMARY AND OBJECTS OF THE INVENTION

Accordingly, it is an object of an embodiment of the present invention to provide a reverse rotation preventive device for an engine of a motorcycle by which the above-mentioned problems involved in the prior art can be solved. More specifically, the engine can be restarted and operation can be continued, without once stopping the vehicle, even in the case where the reverse rotation preventive function is operated due to a momentary locking of the rear wheel.

In order to attain the above object, according to an embodiment of the present invention, a reverse rotation preventive device (30) for an engine of a motorcycle (1) including a crank pulse rotor (50) which is provided with a plurality of reluctors (52) and which is rotated synchronously with a crankshaft (45) of an engine (9), and pulse generators (PC1, PC2) for outputting a pulse signal corresponding to an interval at which the reluctors (52) are arranged, wherein the reverse rotation preventive device (30) has reverse rotation preventive means (302) for inhibiting ignition at an ignition device (35*a*) by operating a reverse rotation preventive function when the interpulse time of the pulse signal exceeds a predetermined time (T), and the reverse rotation preventive means (302) cancels the inhibition of the ignition when it is detected that the crankshaft (45) is in normal rotation after the ignition is inhibited by the operation of the reverse rotation preventive function.

In addition, according to an embodiment of the present invention, the reverse rotation preventive device further includes a stage deciding unit (301) for allocating one revolution of the crankshaft (45) to a plurality of stages on the basis of the crank pulse signal and measuring means (303) for measuring the interpulse time of the crank pulse signal wherein the reverse rotation preventive means (302) includes interpulse time discriminating means (306) for discriminating a plurality of the interpulse times in a predetermined period before passage of a compression top dead center, and crank stage discriminating means (307) for discriminating that a predetermined crank stage (#6) has come after the passage of the compression top dead center.

According to an embodiment of the present invention, the reluctors (52) of the crank pulse rotor (50) are arranged at regular intervals, exclusive of a toothless part (H) at one location, the stage deciding unit (301) makes definite a reference position of the crank pulse rotor (50) on the basis of a crank pulse signal corresponding to the passage of the toothless part (H) and the reverse rotation preventive means (302) cancels the operation of the reverse rotation preventive function so as to permit the ignition when the reference position is made definite and it is decided that the crankshaft (45) is in a normal rotation after the ignition at the ignition device (35*a*) is inhibited by the operation of the reverse rotation preventive function.

In addition, according to an embodiment of the present invention, as the predetermined time (T), two kinds of predetermined times (T1, T2) are selectively applied according to a time elapsed after arrival of a supply voltage for the reverse rotation preventive device (30) for the engine at a predetermined value, and a first predetermined time (T1) is applied until the elapsed time reaches a predetermined value, whereas a second predetermined time (T2) shorter than the first predetermined time (T1) is applied after the elapsed time reaches the predetermined value.

According to an embodiment of the present invention, the motorcycle is a batteryless vehicle which does not have an onboard battery, and the operation of the reverse rotation preventive function is canceled so as to permit the ignition when a supply voltage for the reverse rotation preventive device (30) for the engine is lowered to or below a predetermined reset voltage.

Furthermore, according to an embodiment of the present invention, the conditions of passage of the plurality of reluctors (52) are detected by at least two pulse generators (PC1, PC2), and the at least two pulse generators (PC1, PC2) are arranged so as to detect the passage of a same reluctor at different timings.

According to an embodiment of the present invention, the reverse rotation preventive device has reverse rotation preventive means for inhibiting ignition at an ignition device by operating a reverse rotation preventive function when the interpulse time of the pulse signal exceeds a predetermined time, and the reverse rotation preventive means cancels the inhibition of the ignition when it is detected that the crankshaft is in normal rotation after the ignition is inhibited by the operation of the reverse rotation preventive function. Therefore, at the time of starting the engine by use of a kick starter, ignition is inhibited upon detection of a condition in which the interpulse time detected by the pulse generators has become longer, that is, a condition in which the rotating speed of the crankshaft has been lowered to or below a preset speed making it possible to go over a compression top dead center. Consequently, the generation of reverse rotation at the time of starting the engine by use of the kick starter can be prevented. In addition, even in the case where the reverse rotation preventive function is operated in response to locking of the rear wheel during operation due to a braking operation, the inhibition of ignition is canceled owing to detection of normal rotation of the crankshaft. Therefore, it is possible to restart the engine through driving the rear wheel by the inertia of the vehicle body. As a result, it is unnecessary to stop the vehicle for the purpose of restarting the engine, and smooth operation can be continued.

According to an embodiment of the present invention, the reverse rotation preventive device further includes a stage deciding unit for allocating one revolution of the crankshaft to a plurality of stages on the basis of the crank pulse signal, and measuring means for measuring the interpulse time of the crank pulse signal, and the reverse rotation preventive means includes interpulse time discriminating means for discriminating a plurality of interpulse times in a predetermined period before passage of a compression top dead center, and crank stage discriminating means for discriminating that a predetermined crank stage has come after the passage of the compression top dead center. Therefore, it is possible to accurately detect a lowering in the rotating speed of the crankshaft, and to accurately discriminate the normal rotation state of the crankshaft.

According to an embodiment of the present invention, the reluctors of the crank pulse rotor are arranged at regular intervals, exclusive of a toothless part at one location, the stage deciding unit makes definite a reference position of the crank pulse rotor on the basis of a crank pulse signal corresponding to passage of the toothless part and the reverse rotation preventive means cancels the operation of the reverse rotation preventive function so as to permit the ignition when the reference position is made definite and it is decided that the crankshaft is in normal rotation after the ignition at the ignition device is inhibited by the operation of the reverse rotation preventive function. Therefore, in the case where normal rotation of the crankshaft is started after the ignition is inhibited by the operation of the reverse rotation preventive function, the reverse rotation preventive function can be canceled before one revolution of the crankshaft is performed after the reference position is made definite. Accordingly, it is possible to swiftly restart the engine by the inertia of the vehicle body and to smoothly continue the operation, even in the case where the reverse rotation preventive function is operated in response to locking of the rear wheel due to a braking operation during operation.

According to an embodiment of the present invention, as the predetermined time, two kinds of predetermined times are selectively applied according to a time elapsed after arrival of a supply voltage for the reverse rotation preventive device for the engine at a predetermined value, and a first predetermined time is applied until the elapsed time reaches a predetermined value, whereas a second predetermined time shorter than the first predetermined time is applied after the elapsed time reaches the predetermined value. Therefore, it is possible to make a setting such that the reverse rotation preventive function is not operated unless the rotating speed is lowered greatly, in the beginning stage of a kick starter operation. It is also possible to operate the reverse rotation preventive function even if the degree of lowering in the rotating speed is low, in the middle and late stages of a kick starter operation. Consequently, it is possible to optimize the operating conditions and to enhance startability.

According to an embodiment of the present invention, the motorcycle is a batteryless vehicle which does not have an onboard battery, and the operation of the reverse rotation preventive function is canceled so as to permit the ignition when a supply voltage for the reverse rotation preventive device for the engine is lowered to or below a predetermined reset voltage. Therefore, even in the case where ignition is inhibited by the operation of the reverse rotation preventive function at the time of starting the engine by use of the kick starter, the operation of the reverse rotation preventive function is canceled in response to a condition in which the rotating speed of the crankshaft is lowered and the voltage in the ECU as a reverse rotation preventive device for the engine is lowered to or below the reset voltage, which makes it possible to perform a kick starter operation in the condition where the ignition is allowed. Consequently, it is possible to obtain a reverse rotation preventive device for an engine in which no trouble is generated even when the reverse rotation preventive function is operated at the time of starting the engine by use of the kick starter or during operation, and which is highly convenient to use.

According to an embodiment of the present invention, the conditions of passage of the plurality of reluctors are detected by at least two pulse generators, and the at least two pulse generators are arranged so as to detect the passage of a same reluctor at different timings. Therefore, whether the crankshaft is in a normal rotation or in reverse rotation can be detected before one revolution of the crankshaft is performed. Accordingly, in the case of restarting the engine after the operation of the reverse rotation preventive function during operation, the ignition inhibited condition can be canceled through detecting the normal rotation of the crankshaft before one revolution is performed after the restart of rotation of the crankshaft, so that the engine can be restarted swiftly.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

PREFERRED EMBODIMENTS OF THE INVENTION

Figure 1:
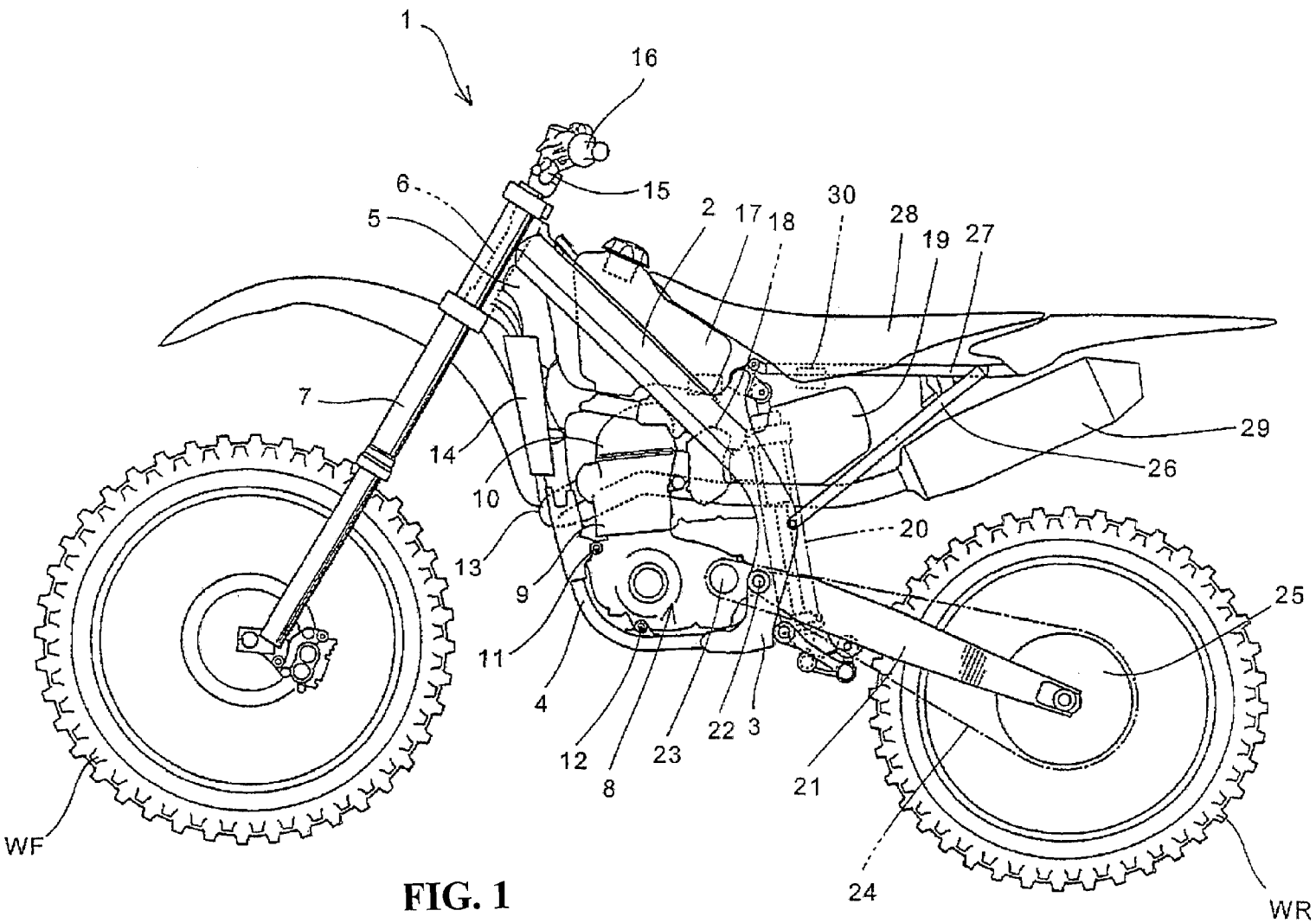
FIG. 1 is a side view of a motorcycle to which a reverse rotation preventive device for an engine according to one embodiment of the present invention is applied.

Now, a preferred embodiment of the present invention will be described in detail below referring to the drawings. FIG. 1 is a side view of a motorcycle 1 to which a reverse rotation preventive device for an engine according to an embodiment of the present invention is applied. To the front side of a left-right pair of main frames 2, a head pipe 6 for turnably supporting a steering stem (not shown) is joined. A left-right pair of front fork members 7 for turnably bearing a front wheel WF is mounted to the steering stem. A steering handle 15 for steering the front wheel WF is attached to upper end portions of the front fork members 7. The steering handle 15 is fitted with a left-right pair of handle grips 16. The handle grip 16 on the right side in the vehicle width direction is turnably mounted to the steering handle 15, and an output of an engine 8 as a power source is regulated by a turning operation of the right-side handle grip 16.

To a down frame 5 connected to the head pipe 6 and extending downward, a left-right pair of lower frames 4 are connected. The engine 8 is supported by mount portions 11, 12 of the lower frames 4. A cylinder 9 and a cylinder head 10 are fixed to an upper portion of the engine 8, and an exhaust pipe 13 attached to the cylinder 9 extends toward the rear side of the vehicle body, to be connected to a muffler 29. In addition, a throttle body 18 including a fuel injection device 36 (see FIG. 2) and an air cleaner box 19 are disposed on the vehicle body rear side of the cylinder 9.

To a rear lower side of the main frames 2, a left-right pair of center frames 3 are joined. On a swing arm pivot 22 provided on the center frames 3, a swing arm 21 suspended from the main frames 2 by a rear shock absorber 20 is swingably supported. On a rear end portion of the swing arm 21, a rear wheel WR is turnably borne. Rotational driving force generated by the engine 8 is transmitted to a driven sprocket 25 secured to the rear wheel WR, through a drive chain 24 wrapped around a drive sprocket 23.

A fuel tank 17 is disposed on the upper side of the cylinder head 10 and between the left-right pair of main frames 2. Seat rails 27 and rear frames 26 are connected to rear portions of the main frames 2. A seat 28 is attached to upper portions of the seat rails 27, and an ECU 30 as a reverse rotation preventive device for an engine inclusive of reverse rotation preventive means is disposed under the seat 28.

Figure 2:
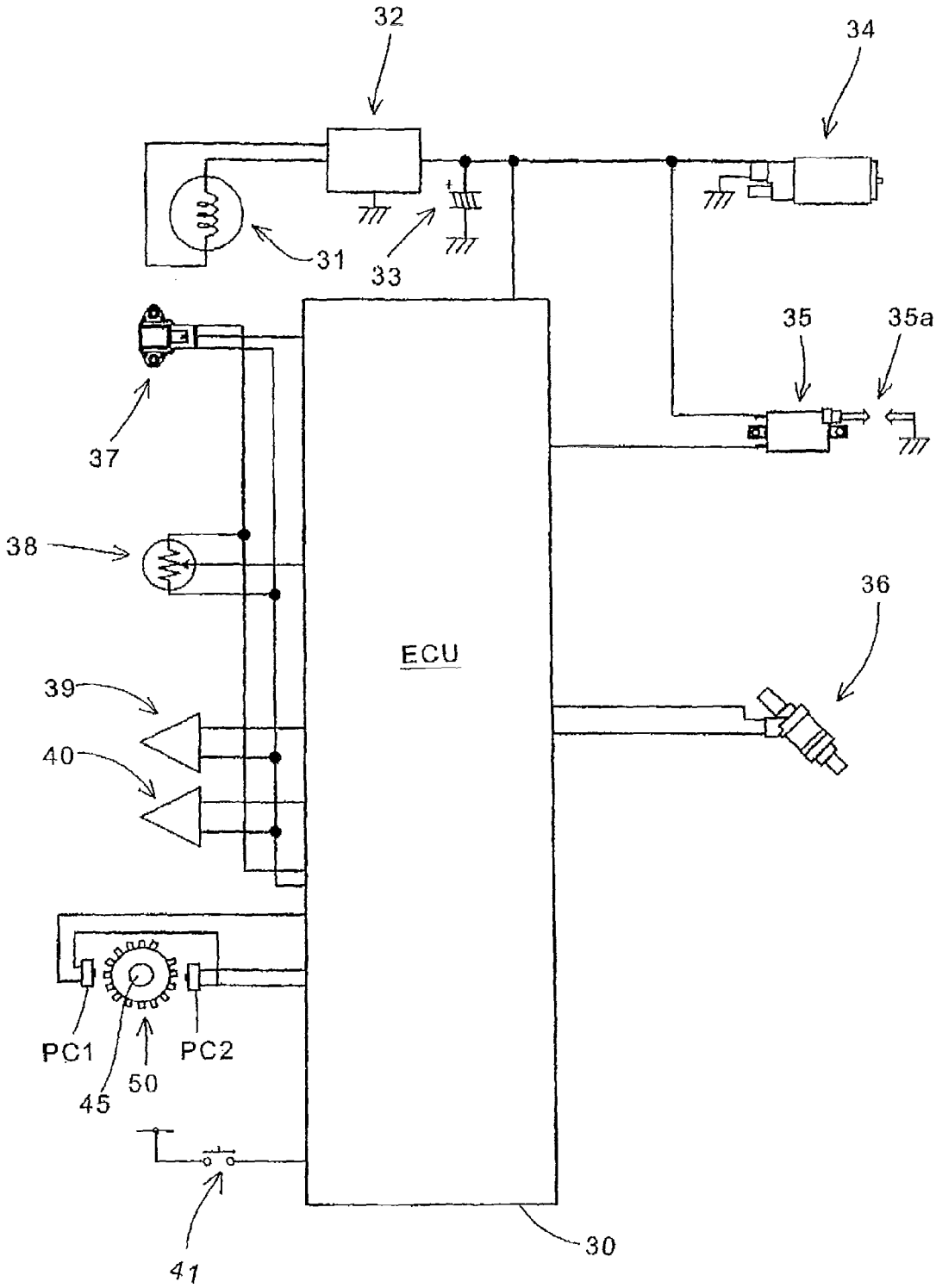
FIG. 2 is a block diagram illustrating the configuration of an ECU and peripheral electric equipments.

FIG. 2 is a block diagram showing the configuration of the ECU 30 and peripheral electric equipments. To the motorcycle 1 according to this embodiment, a batteryless system which does not have an onboard battery is applied and in which only electric power generated by a generator 31 rotated synchronously with a crankshaft 45 of the engine 8 is used as an electric power source for various electric equipment. The electric power supplied from the generator 31 is rectified by a regulator-rectifier 32, before being supplied to an electrolytic capacitor 33, the ECU 30, a fuel pump 34, an ignition coil 35 and the like. The ignition timing of a spark plug 35*a* and an injection timing of a fuel injector 36 are controlled by the ECU 30 serving as an engine controller.

The ECU 30 is supplied with output signals from an intake pressure sensor (PB sensor) 37 for detecting a manifold air pressure generated in an intake pipe of the engine 8, a throttle sensor 38 for detecting the position (opening) of a throttle valve (not shown) disposed inside the throttle body 18, an intake temperature sensor 39 for detecting the intake temperature, and a water temperature sensor 40 for detecting the cooling water temperature at the engine 8. In addition, a crank pulse rotor 50 with a plurality of reluctor attached thereto is mounted onto the crankshaft 45 of the engine 8. The ECU 30 can detect the rotational position and the rotating speed of the crankshaft 45 by a system in which the condition of passage of the reluctors is detected as a pulse signal by magnetic pick-up type pulse generators PC1 and PC2. The ECU 30 is provided also with an engine stop switch which, when operated by the driver, can inhibit the operation of the ignition device.

Figure 3:
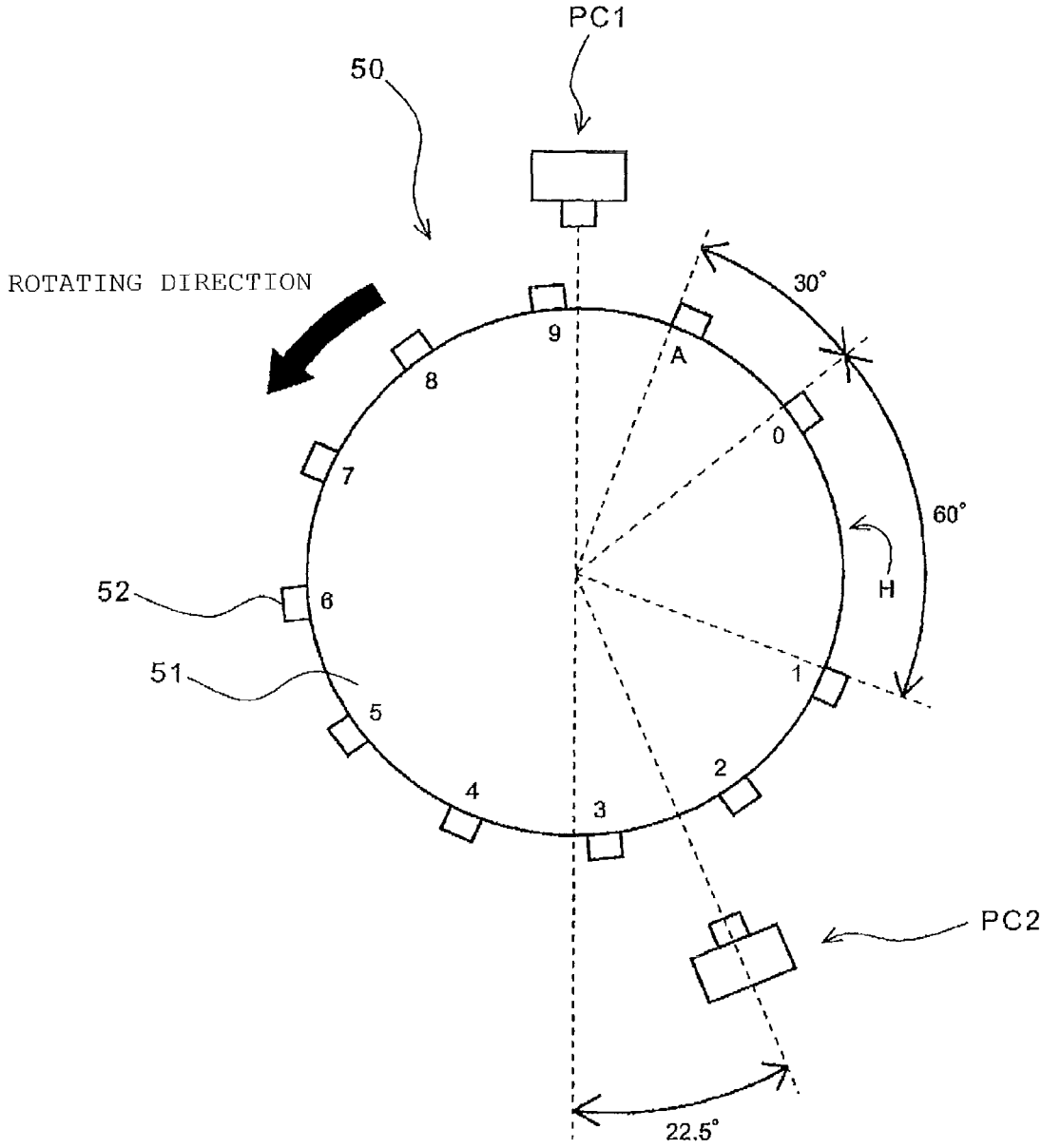
FIG. 3 is an enlarged front view of a crank pulse rotor.

FIG. 3 is an enlarged front view of the crank pulse rotor 50. The crank pulse rotor 50 has a configuration in which a rotor 51 rotated synchronously with the crankshaft 45 is provided with a total of eleven reluctors 52 (1 to 9, A, and 0) which are arranged at an interval of 30 degrees, exclusive of a toothless part (H) at one location. A crank pulse signal is detected by a first pulse generator PC1 and a second pulse generator PC2. The second pulse generator PC2 is disposed at a position reached by a rotation of 22.5 degrees in the rotating direction of the crank pulse rotor 50 from a position which is opposite to the first pulse generator PC1. In this embodiment, two pulse generators are provided, whereby a reverse rotation state of the crankshaft can also be detected.

Figure 4:
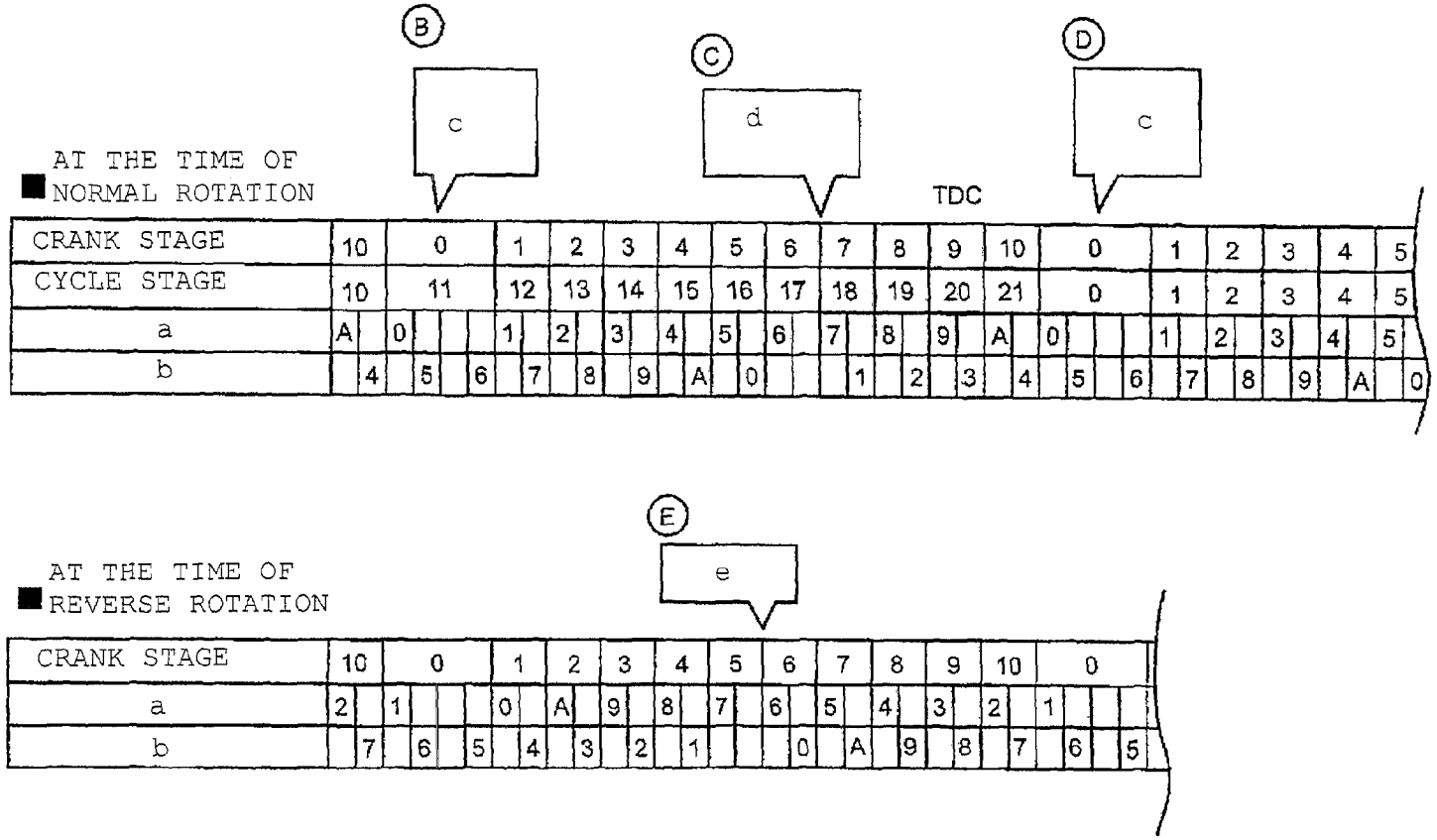
FIG. 4 is a table showing the conditions of passage of reluctors detected at the times of normal rotation and reverse rotation of a crankshaft.

FIG. 4 is a table showing the conditions of passage of the reluctors detected at the time of normal rotation (normal-rotation time) and at the reverse-rotation time of the crankshaft. First, referring to the normal-rotation time set forth in the top part of the table, the "crank stage" in the table relates to a total of eleven stages into which one revolution of the crankshaft 1 is divided on the basis of the layout of the reluctors. The division of the "crank stage" and the allocation of numbers are carried out based on an output signal from the first pulse generator PC1.

The "cycle stage" in the table relates to a total of twenty-two stages #0 to #21 into which two revolutions of the crankshaft are divided based on the detection results of the "crank stage," variations in the intake pressure detected by the intake pressure sensor 37, and the like. The "cycle stage" is assigned a tentative number until a stroke discriminating process based on the variations in the intake pressure and the like is completed and it is made clear whether the crankshaft is currently in the first revolution or the second revolution in one cycle (two revolutions: 720 degrees).

This table shows the conditions of passage of the reluctors during normal operation in the condition where discrimination of the engine stroke has been completed, starting the description from the position before the reluctor #A passes the first pulse generator PC1. First, when the reluctor #A has passed the first pulse generator PC1, it is detected that the crank stage #10 has been started. Then, following to detection of the reluctor #4 by the second pulse generator PC2, the passage of the reluctor #0 is detected by the first pulse generator PC1, whereon it is ascertained that the process has proceeded to the next crank stage.

Subsequently, the second pulse generator PC2 detects the passage of the reluctor #5. In the next place, however, due to the presence of the toothless part (H) over an interval of 60 degrees amid the array of the reluctors, the second pulse generator PC2 detects the passage of the reluctor #6 before the first pulse generator PC1 detects the passage of any reluctor. As a result, the presence of the toothless part (H) is confirmed, and it is made clear that the current crank stage is #0. Accordingly, a reference position of the crankshaft is made definite (B). With the reference position thus made definite, the ECU 30 becomes able to discriminate the numbers of the reluctors which will pass by subsequently. The ECU 30 performs the confirmation of the reference position of the crankshaft every one revolution of the crankshaft (B, D). In addition, in the case where the discrimination of the engine stroke is completed in making the reference position definite (B), the crank stage proves to be #0 and, simultaneously, the cycle stage proves to be #11.

When the crank stage #6 as a previously set "predetermined crank stage" is detected after the reference position of the crankshaft is made definite, the result of a stage judgment is OK (C), that is, it is judged that there is no error in the process of making definite the reference position of the crankshaft and that the crankshaft is rotating normally, whereby a normal rotation state of the crankshaft is detected. Thus, discrimination of whether or not the predetermined crank stage (#6) has come after the passage of the compression top dead center is executed by stage discriminating means (see FIG. 5) which will be described later. In addition, discrimination of the stroke on the basis of variations in the intake pressure is carried out, for example, by a method in which a rising-and-falling pattern of the intake pressure detected is collated with intake pressure patterns which have been preliminarily obtained by experiments or the like and are correlated with cycle stages.

The pulse generators PC1 and PC2 can only detect the passage of each reluctor, and the discrimination of the reluctor is carried out by counting the number of the reluctors passing by. Therefore, in the case where the rotating state of a crank pulse rotor 50 as shown in FIG. 3 is detected by a single pulse generator, it is impossible to detect a reverse rotation state of the crankshaft. On the other hand, in this embodiment, the two pulse generators are provided so that a reverse rotation state can be detected before one revolution of the crankshaft is performed.

Referring to the bottom part of the table shown in FIG. 4, the "crank stages" are allocated on the assumption that the crankshaft is in a normal rotation state, even when the crankshaft is actually in reverse rotation. Besides, as above-mentioned, discrimination of each reluctor is carried out by counting the number of the reluctors passing by. Therefore, until the process enters the crank stage #5 after reverse rotation of the crankshaft is started, the crank pulses outputted from the pulse generators PC1 and PC2 are the same as those outputted during normal rotation. Here, after the reluctor has passed the first pulse generator PC1 in the crank stage #5, a reluctor should then pass the second pulse generator PC2 if the crankshaft is in a normal rotation state. Actually, however, the first pulse generator PC1 detects the passage of a reluctor before the second pulse generator PC2 does. This enables the ECU 30 to detect that the pulse output pattern is different from the pattern during normal rotation, and, hence, to recognize that the crankshaft is in a reverse rotation state.

Figure 5:
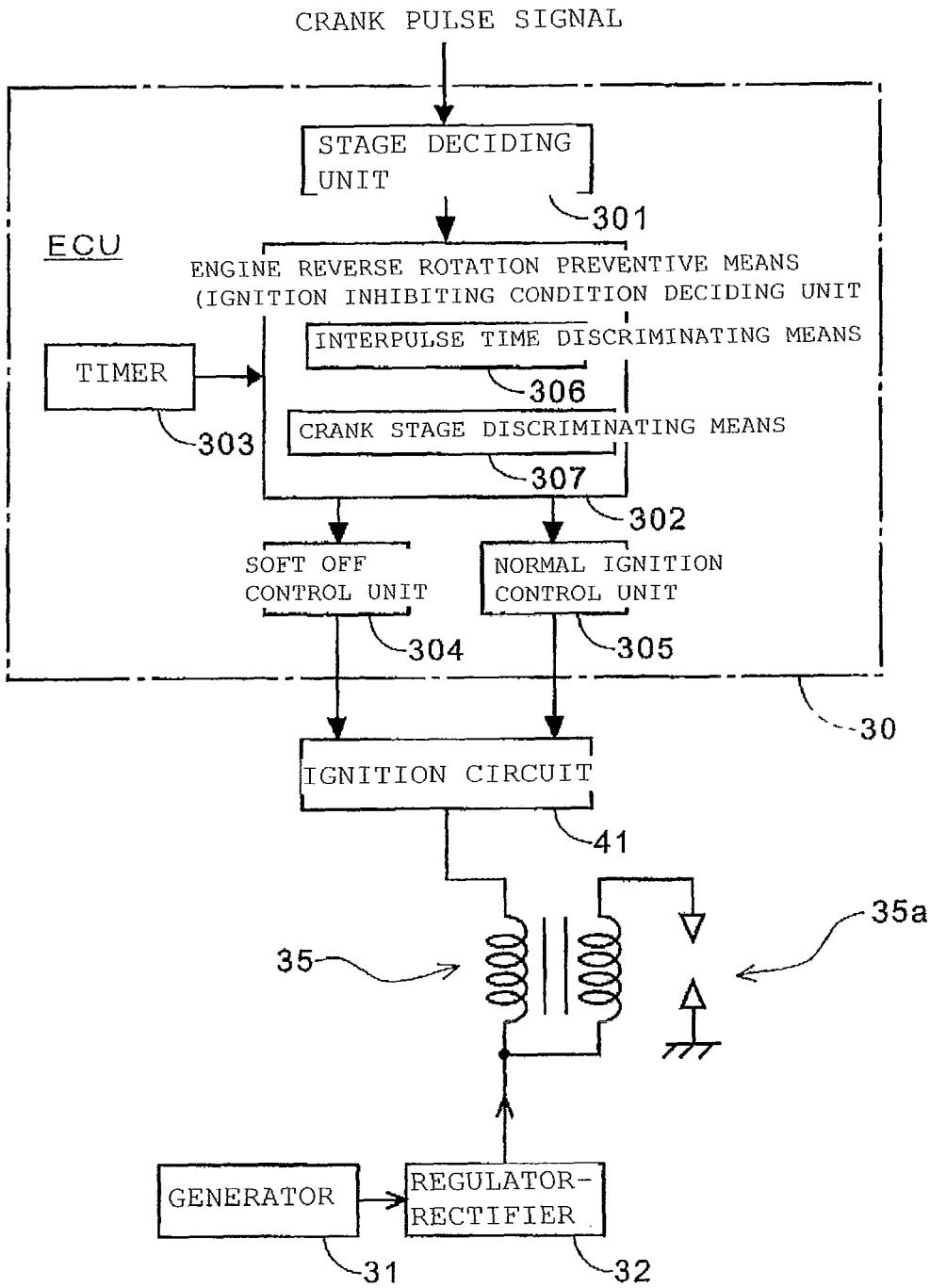
FIG. 5 is a functional block diagram illustrating the configuration of the ECU and peripheral electric equipments.

FIG. 5 is a functional block diagram illustrating the configuration of the ECU 30 and the peripheral equipments. The same reference symbols as those used above denote the parts identical or equivalent to those described above. The ECU 30 includes a reverse rotation preventive device for preventing generation of reverse rotation at the time of starting the engine by use of a kick starter. The ECU 30 includes: a stage deciding unit 301 for deciding a crank stage and a cycle stage on the basis of the crank pulse signals; reverse rotation preventive means 302 as an ignition inhibiting condition deciding unit for deciding if it is necessary or unnecessary to inhibit ignition at the spark plug 35*a* in order to prevent reverse rotation; a timer 303 as a measuring means for measuring a predetermined time; a soft off control unit 304 for driving an ignition circuit 41 when inhibiting ignition; and a normal ignition control unit 305 for driving the ignition circuit 41 at a normal ignition timing in the case where it is unnecessary to inhibit ignition. The reverse rotation preventive means 302 includes interpulse time discriminating means 306 for discriminating a plurality of interpulse times in a predetermined period before passage of the compression top dead center, and crank stage discriminating means 307 for discriminating that a predetermined crank stage has come after passage of the compression top dead center.

The ignition coil 35 and the spark plug 35*a* are connected to the ignition circuit 41. The ignition coil 35 is supplied with electric power generated by the generator 31 and rectified by the regulator-rectifier 32. Now, the procedures of operating the reverse rotation preventive function and canceling the operation will be described in detail below, referring to FIGS. 6 to 8.

Figure 6:
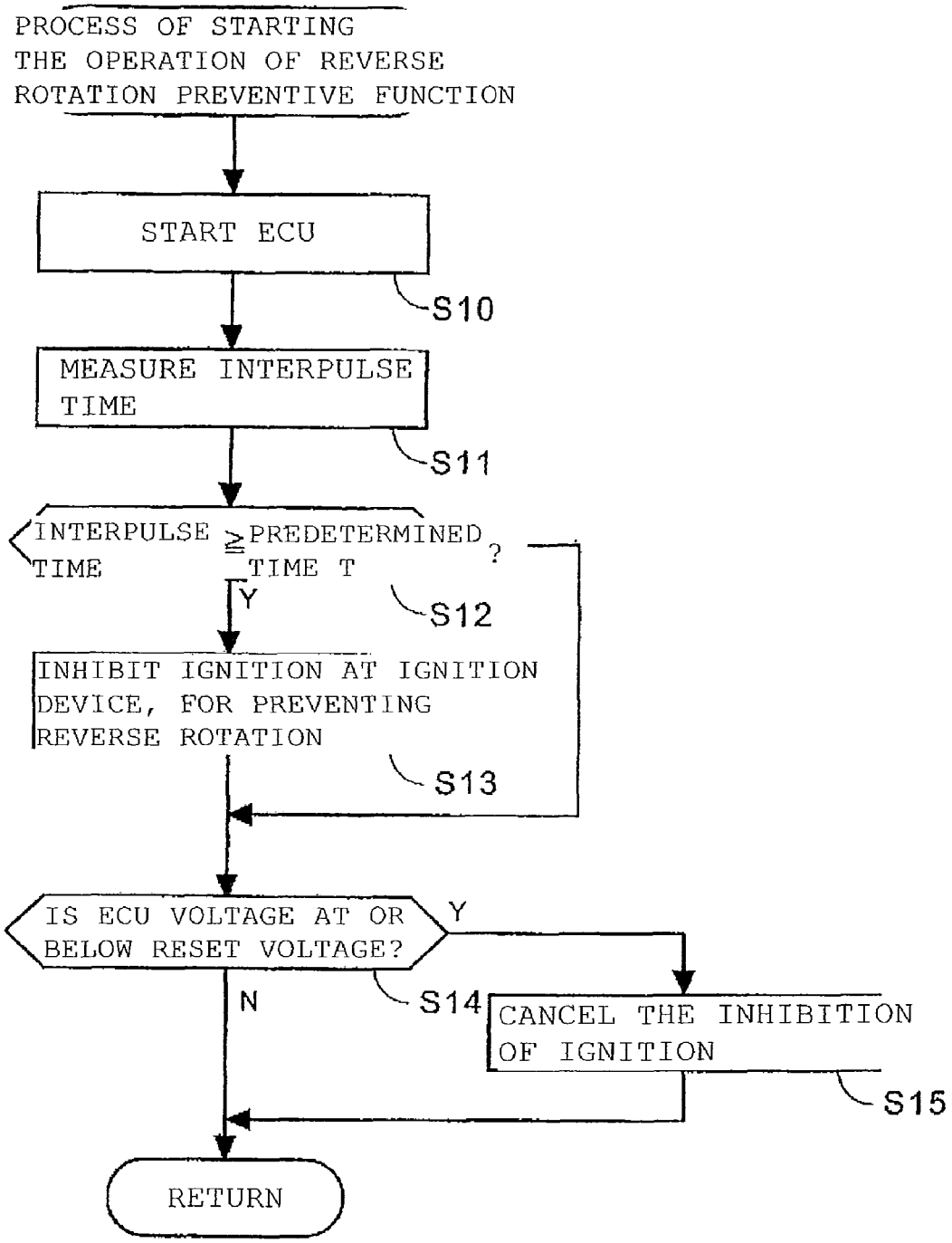
FIG. 6 is a flow chart showing the procedure of a process for starting the operation of a reverse rotation preventive function.

FIG. 6 is a flow chart showing the procedure of a process of starting the operation of the reverse rotation preventive function. The motorcycle 1 pertaining to this embodiment is of a batteryless type, in which the engine 8 is started by use of a kick starter. In addition, before the ECU 30 is started, the motorcycle 1 is in the condition where ignition at the ignition device is permitted. Moreover, it is ensured that even in the case where the ignition inhibiting condition is satisfied after the starting, the system is returned to the ignition permitted condition when the voltage supplied to the ECU 30 is lowered to or below a predetermined value (for example, 4 V).

In this flow chart, the flow in starting the engine 8 by use of the kick starter is assumed. First, in step S10, the rotating speed of the crankshaft 45 rises after the operation of the kick starter is started, and the electric power from the generator exceeds a starting voltage for the ECU 30, whereby the ECU 30 is started. In the subsequent step S11, measurement of the interpulse time of the crank pulse signal by the timer 303 is started. The measurement of the interpulse time is carried out by interpulse time discriminating means 306 (see FIG. 5) in each of the intervals between the reluctors arranged at an interval of 30 degrees, exclusive of the toothless part (H). Here, in order to prevent reverse rotation of the crankshaft at the time of starting the engine by use of the kick starter, particularly, the result of measurement in a predetermined period before passage of the compression top dead center serves as effective information. In step S12, it is decided, by the reverse rotation preventive means 302 (see FIG. 5), whether or not the interpulse time has reached or exceeded a predetermined time T.

When the result of decision in step S12 is affirmative (Y), that is, when it is detected that the interpulse time has become longer and the rotating speed of the crankshaft has been lowered below a preset speed making it possible to go beyond the compression top dead center without trouble, it is judged that reverse rotation may possibly be generated, and the control proceeds to step S13.

Figure 9:
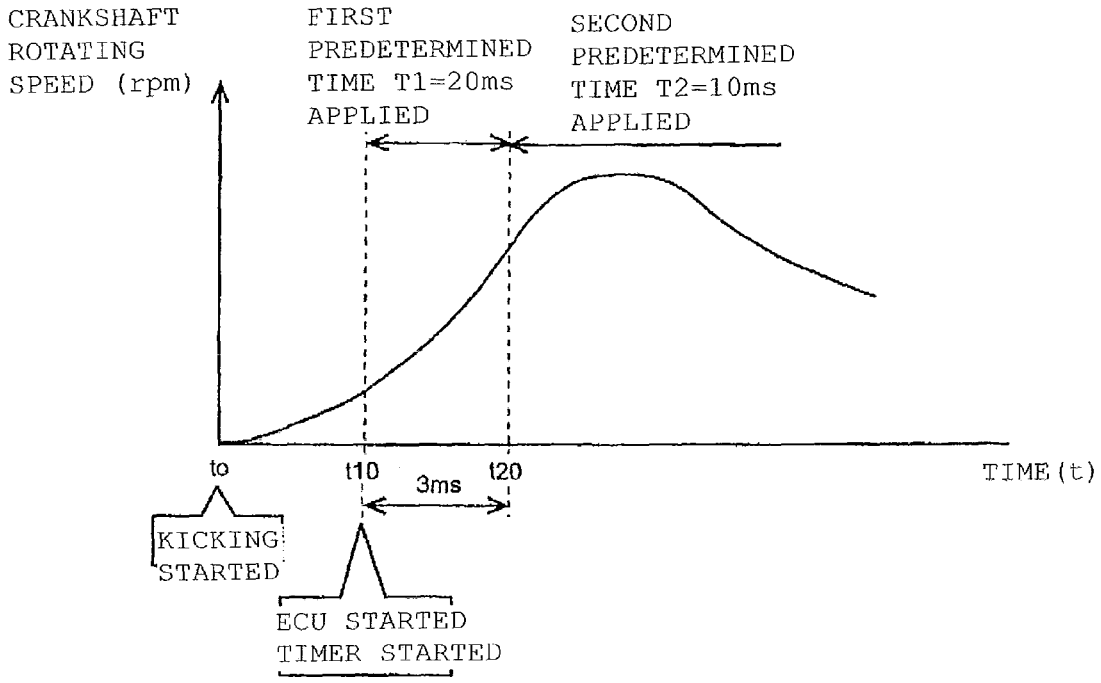
FIG. 9 is a table showing the conditions of switch-over of operation starting conditions for the reverse rotation preventive function.

Here, as the predetermined time T used in step S12, two kinds of predetermined times are selectively applied, according to the time elapsed after the start of the ECU 30. As shown in FIG. 9, in this embodiment, the predetermined time T is set to be 20 ms (in terms of rotating speed, about 250 rpm) where the time elapsed after the start of the ECU 30 is less than 3 ms. On the other hand, where the time elapsed after the start of the ECU 30 is not less than 3 ms, the predetermined time T is set to be 10 ms (in terms of rotating speed, about 500 rpm).

According to such settings of the predetermined time T, it is ensured that in the beginning stage of the kick starter operation, the reverse rotation preventive function does not operate unless the crankshaft rotating speed is lowered greatly. It is also ensured that in the middle and later stages of the kick starter operation, the reverse rotation preventive function is permitted to operate even if the degree of lowering in the rotating speed is small. As a result, it becomes possible to optimize the operating conditions and to enhance startability. In addition, the settings of the predetermined time T may be arbitrarily modified according to engine specifications or the like.

Returning to the flow chart shown in FIG. 6, in step S13, ignition at the spark plug 35*a* by the ignition device is inhibited, in order to prevent reverse rotation. In the subsequent step S14, it is decided whether or not the voltage on the ECU 30 is at or above a reset voltage. When the result of decision in step S14 is affirmative (Y), the control proceeds to step S15, in which the inhibition of ignition for preventing reverse rotation is canceled. In addition, as above-mentioned, the ECU 30 is so configured as to cancel (reset) the reverse rotation preventive function when the supply voltage is lowered to or below a preset value. Therefore, in the case where the engine is not started due to the reverse rotation preventive function operating at the time of starting by use of the kick starter, the reverse rotation preventive function is canceled, without especially performing the decision in step S14.

On the other hand, when the result of decision in step S14 is negative (N), that is, when it is decided that electric power in excess of the predetermined reset voltage is being supplied, a series of control actions is finished while maintaining the condition where the ignition is inhibited. The case where the result of decision in step S14 is negative (N) corresponds to the case where the reverse rotation preventive function is operated in response to momentary locking of the rear wheel by a braking operation during operation, then the brake operation is immediately canceled and the power supply by the generator 31 is restarted, and, as a result, the voltage on the ECU 30 is recovered without being lowered to or below the reset voltage. Such a situation is said to be liable to occur, for example, in the case where a batteryless vehicle having a fuel injection device is provided in its electric circuitry with a capacitor of a large capacity for stably operating the fuel injection device.

Figure 7:
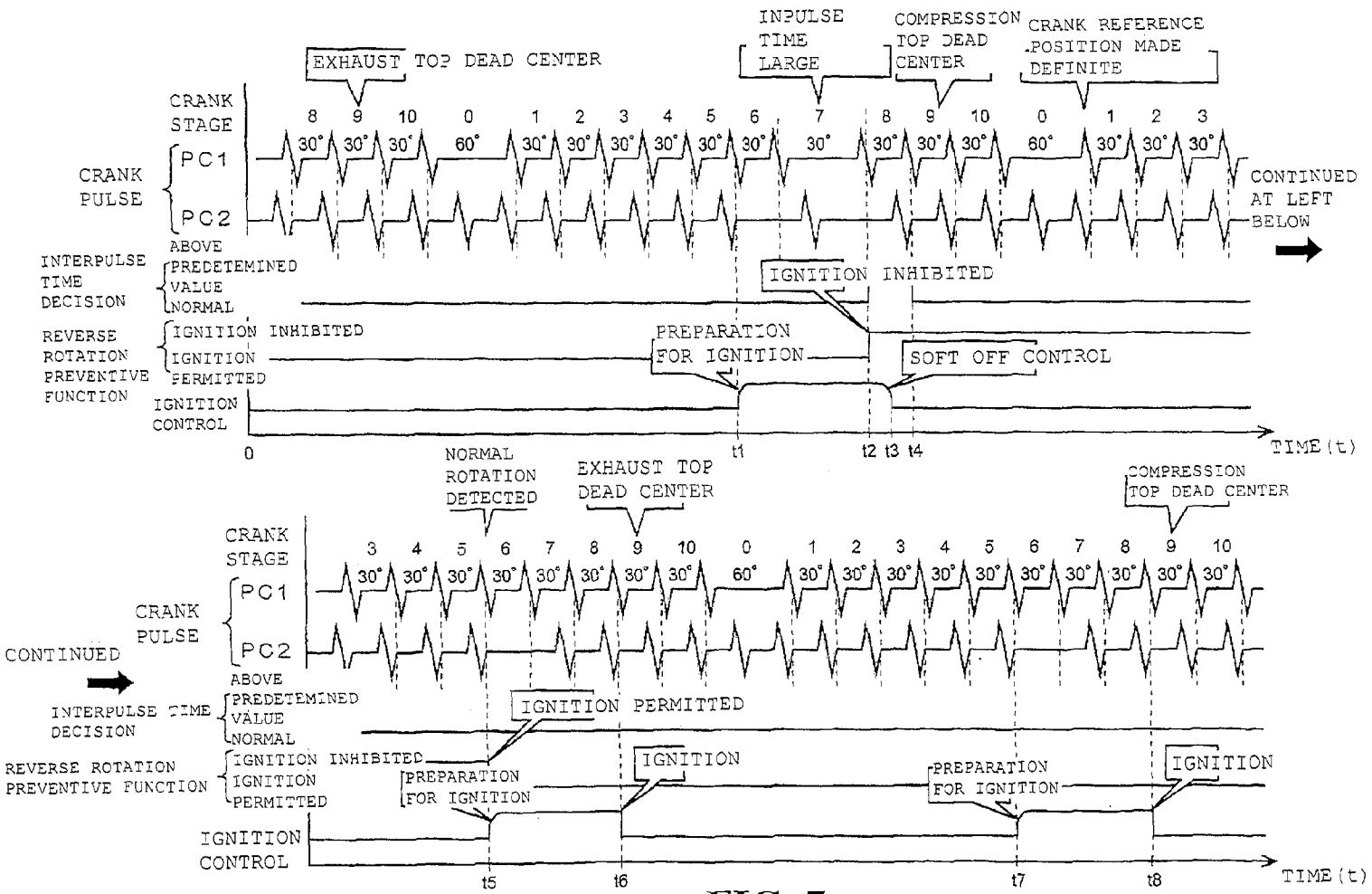
FIG. 7 is a time chart illustrating the flow from the start of operation to the canceling of operation of the reverse rotation preventive function during operation.
Figure 8:
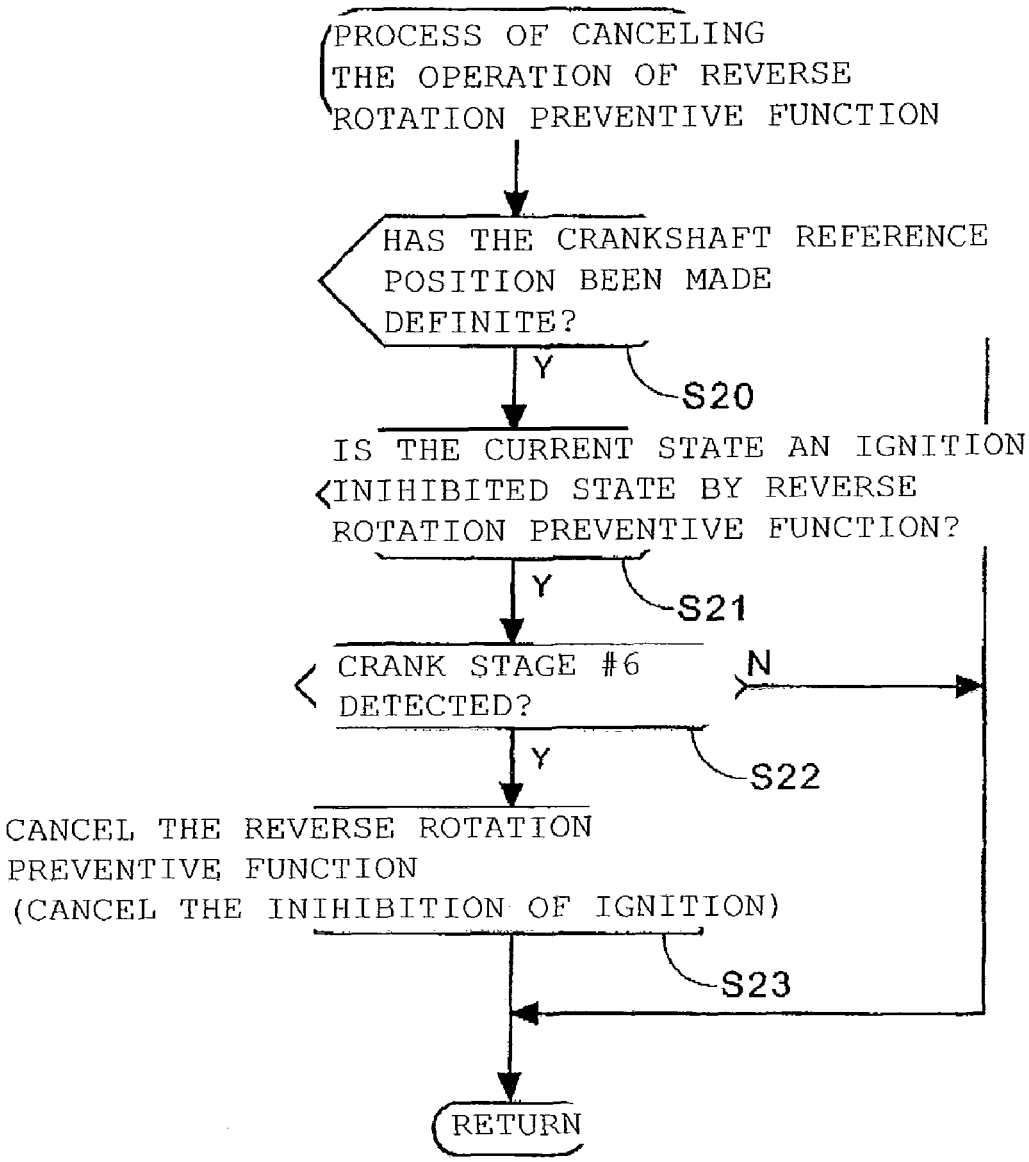
FIG. 8 is a flow chart showing the procedure of a process for canceling the operation of the reverse rotation preventive function.

FIG. 7 is a time chart for illustrating the flow from the start of operating the reverse rotation preventive function during operation to the cancellation of the operation. FIG. 8 is a flow chart for showing the procedure of canceling the operation of the reverse rotation preventive function. The time chart in FIG. 7 shows crank stage, crank pulse (PC1, PC2), interpulse time decision (in excess of a predetermined value, or normal), reverse rotation preventive function (ignition inhibited, or ignition permitted), and ignition control state, in this order from the upper side toward the lower side.

The ECU 30 pertaining to this embodiment is so set that, during normal ignition control, preparation for ignition is started at the time of start of crank stage #6, and ignition is performed at the time of start of crank stage #9. At time t1, the preparation for ignition is started, based on this setting for normal ignition control. In the next crank stage #7, however, due to the locking of the rear wheel attendant on a braking operation during operation, the interpulse time is made longer, and the decision condition for operating the reverse rotation preventive function (for example, the condition that the crankshaft rotating speed is at or below 500 rpm) is therefore satisfied notwithstanding the vehicle is operating. As a result, at time t2, the reverse rotation preventive function operates, to inhibit the ignition by the ignition device.

In this embodiment, the control system is set so as to execute a soft off control for driving a switching element so that a primary current for the ignition coil is cut off at a predetermined gradient, at the time of inhibiting the ignition by the reverse rotation preventive function. In the example shown in FIG. 7, this soft off control is carried out, whereby the ignition circuit is returned, at time t3, to the state before the preparation for ignition.

Subsequently, at time t4, the rotating speed of the crankshaft has returned to the state before the locking of the rear wheel. This corresponds to a condition in which the driver cancels the brake operation and engages the clutch, trying to restart the engine through rotating the rear wheel by the inertia of the vehicle body. However, in the process of starting the operation of the reverse rotation preventive function described in the flow chart in FIG. 6, the inhibition of ignition would not be canceled unless the voltage on the ECU 30 is lowered below the reset voltage. Accordingly, the engine is not restarted, even if the rotating speed of the rear wheel is sufficiently high for restarting the engine.

To cope with such a problem, in the reverse rotation preventive device for an engine pertaining to the present invention, a configuration is adopted in which after an ignition inhibited state is established by the reverse rotation preventive function, the ignition inhibited state is canceled upon detection of a normal rotation state of the crankshaft, even if the voltage on the ECU 30 is not lowered below the reset voltage. This makes it possible to restart the engine through rotating the rear wheel by the inertia of the vehicle body, and to continue operation. Now, the process of canceling the operation of the reverse rotation preventive function will be described below, referring to FIGS. 7 and 8.

FIG. 8 is a flow chart for showing the flow of the process for canceling the operation of the reverse rotation preventive function. In step S20, it is decided whether or not the reference position of the crankshaft is made definite. When the result of the decision in step S20 is affirmative (Y), the control proceeds to step S21, in which it is decided whether or not the current state is an ignition inhibited state attendant on the operation of the reverse rotation preventive function. When the result of decision in step S21 is affirmative (Y), the control proceeds to step S22, in which it is decided whether or not crank stage #6 has been detected; in other words, it is decided whether or not a normal rotation state of the crankshaft has been detected. The decision in step S22 is carried out by the normal rotation/reverse rotation deciding method mentioned above (see FIG. 4). In the method, more specifically, when crank stage #6 is properly detected after the reference position of the crankshaft is made definite, it is recognized that the crankshaft is in a normal rotation state, whereas when crank stage #6 is not detected after the reference position of the crankshaft is made definite, it is judged that the crankshaft is in a reverse rotation state.

When the result of decision in step S22 is affirmative (Y), that is, when it is decided that the crankshaft is in the normal rotation state, the control proceeds to step S23, in which the reverse rotation preventive function is canceled, whereby the ignition inhibited state is canceled. In addition, when the result of decision in any of steps S20, S21 and S22 is negative (N), a series of control actions is finished, without canceling the reverse rotation preventive function.

Returning to the time chart in FIG. 7, the flow up to cancellation of the reverse rotation preventive function once operated during operation will be described. As above-mentioned, at time t4, the rotating speed of the crankshaft has already been recovered to the rotating speed before the locking of the rear wheel, so that the supply voltage on the ECU 30 would not be below the predetermined reset voltage. Accordingly, cancellation of the reverse rotation preventive function by resetting of the ECU 30 is not conducted. Thereafter, when the normal rotation state of the crankshaft is continued, the reference position of the crankshaft is made definite at the time of start of crank stage #1.

Subsequently, at time t5, the start of crank stage #6 is detected normally, which results in that the normal rotation state of the crankshaft is recognized by the ECU 30. In this embodiment, the timing of recognition of the normal rotation state and the timing of starting the preparation for ignition coincide with each other on the crank stage; therefore, at time t5, the inhibition of ignition is canceled and, simultaneously, the preparation for ignition is started. According to such a setting for canceling the inhibition of ignition, the inhibition of ignition is canceled within one revolution of the crankshaft from the time when the reference position is made definite, even in the case where the reverse rotation preventive function is operated during operation. Therefore, it is possible to swiftly restart the engine before the inertia of the vehicle body is lowered, and to continue operation.

In addition, the ECU 30 is so set as to reset the results of engine stroke discrimination, attendant on the operation of the reverse rotation preventive function, even in the case where the supply voltage on the ECU 30 is not lowered below the predetermined reset voltage. This results in that the stroke discriminating process must again be executed at the time of restarting the engine. At time t6, the stroke discriminating process has not yet been completed. Therefore, preparation for ignition by waste ignition at the exhaust top dead center (360-degrees ignition) which is deviated by one crankshaft revolution (360 degrees) from the original ignition timing is started. Thereafter, when the stroke discriminating process is completed, an ignition control at a predetermined timing ahead of the compression top dead center is carried out by the normal ignition control unit 305.

As above-mentioned, according to the reverse rotation preventive device for an engine pertaining to the present invention, even in the case where ignition is inhibited by an operation of the reverse rotation preventive function during operation, the inhibition of ignition is canceled in response to detection of normal rotation of the crankshaft, so that the engine can be restarted through driving the rear wheel by the inertia of the vehicle body. This eliminates the need to stop the vehicle for restarting the engine, and makes it possible to smoothly continue the operation. In addition, after ignition is inhibited by the operation of the reverse rotation preventive function during operation, the ignition inhibited state is continued unless a normal rotation state of the crankshaft is detected. This prevents ignition from being carried out in the condition where the crankshaft is in reverse rotation. Consequently, an appropriate ignition control can be performed.

In addition, it should be noted that the shapes and layout of the crank pulse rotor and the reluctors, the number and shape of the pulse generators, the method of detecting the normal rotation of the crankshaft, the setting of the interpulse time for operating the reverse rotation preventive function, etc. are not limited to those in the embodiment described above, and various modifications of them are possible. The reverse rotation preventive device for an engine according to the present invention is applicable to various vehicles of the batteryless type in which an engine is started by use of a kick starter.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A reverse rotation preventive device for an engine of a motorcycle comprising:

a crank pulse rotor provided with a plurality of reluctors and which is rotated synchronously with a crankshaft of an engine;

pulse generators for outputting a pulse signal corresponding to an interval at which the reluctors are arranged;

wherein the reverse rotation preventive device has reverse rotation preventive means for inhibiting ignition at an ignition device by operating a reverse rotation preventive function when an interpulse time of the pulse signal exceeds a predetermined time; and the reverse rotation preventive means cancels the inhibition of the ignition when it is detected that the crankshaft is in normal rotation after the ignition is inhibited by the operation of the reverse rotation preventive function.

2. The reverse rotation preventive device for an engine of a motorcycle according to claim 1, and further comprising:

a stage deciding unit for allocating one revolution of the crankshaft to a plurality of stages on the basis of the crank pulse signal; and measuring means for measuring the interpulse time of the crank pulse signal;

wherein the reverse rotation preventive means includes interpulse time discriminating means for discriminating a plurality of the interpulse times in a predetermined period before passage of a compression top dead center, and crank stage discriminating means for discriminating that a predetermined crank stage has come after the passage of the compression top dead center.

3. The reverse rotation preventive device for an engine of a motorcycle according to claim 1, wherein the reluctors of the crank pulse rotor are arranged at regular intervals, exclusive of a toothless part at one location;

the stage deciding unit makes definite a reference position of the crank pulse rotor on the basis of a crank pulse signal corresponding to passage of the toothless part; and the reverse rotation preventive means cancels the operation of the reverse rotation preventive function so as to permit the ignition when the reference position is made definite and it is decided that the crankshaft is in normal rotation after the ignition at the ignition device is inhibited by the operation of the reverse rotation preventive function.

4. The reverse rotation preventive device for an engine of a motorcycle according to claim 2, wherein the reluctors of the crank pulse rotor are arranged at regular intervals, exclusive of a toothless part at one location;

the stage deciding unit makes definite a reference position of the crank pulse rotor on the basis of a crank pulse signal corresponding to passage of the toothless part; and the reverse rotation preventive means cancels the operation of the reverse rotation preventive function so as to permit the ignition when the reference position is made definite and it is decided that the crankshaft is in normal rotation after the ignition at the ignition device is inhibited by the operation of the reverse rotation preventive function.

5. The reverse rotation preventive device for an engine of a motorcycle according to claim 1, wherein as the predetermined time, two kinds of predetermined times are selectively applied according to a time elapsed after arrival of a supply voltage for the reverse rotation preventive device at a predetermined value; and a first predetermined time is applied until the elapsed time reaches a predetermined value, whereas a second predetermined time shorter than the first predetermined time is applied after the elapsed time reaches the predetermined value.

6. The reverse rotation preventive device for an engine of a motorcycle according to claim 2, wherein as the predetermined time, two kinds of predetermined times are selectively applied according to a time elapsed after arrival of a supply voltage for the reverse rotation preventive device at a predetermined value; and a first predetermined time is applied until the elapsed time reaches a predetermined value, whereas a second predetermined time shorter than the first predetermined time is applied after the elapsed time reaches the predetermined value.

7. The reverse rotation preventive device for an engine of a motorcycle according to claim 3, wherein as the predetermined time, two kinds of predetermined times are selectively applied according to a time elapsed after arrival of a supply voltage for the reverse rotation preventive device at a predetermined value; and a first predetermined time is applied until the elapsed time reaches a predetermined value, whereas a second predetermined time shorter than the first predetermined time is applied after the elapsed time reaches the predetermined value.

8. The reverse rotation preventive device for an engine of a motorcycle according to claim 1, wherein the motorcycle is a batteryless vehicle which does not have an onboard battery; and the operation of the reverse preventive function is canceled so as to permit the ignition when a supply voltage for the reverse rotation preventive device is lowered to or below a predetermined reset voltage.

9. The reverse rotation preventive device for an engine of a motorcycle according to claim 2, wherein the motorcycle is a batteryless vehicle which does not have an onboard battery; and the operation of the reverse preventive function is canceled so as to permit the ignition when a supply voltage for the reverse rotation preventive device is lowered to or below a predetermined reset voltage.

10. The reverse rotation preventive device for an engine of a motorcycle according to claim 3, wherein the motorcycle is a batteryless vehicle which does not have an onboard battery; and the operation of the reverse preventive function is canceled so as to permit the ignition when a supply voltage for the reverse rotation preventive device is lowered to or below a predetermined reset voltage.

11. The reverse rotation preventive device for an engine of a motorcycle according to claim 4, wherein the motorcycle is a batteryless vehicle which does not have an onboard battery; and the operation of the reverse preventive function is canceled so as to permit the ignition when a supply voltage for the reverse rotation preventive device is lowered to or below a predetermined reset voltage.

12. The reverse rotation preventive device for an engine of a motorcycle according to claim 1, wherein the conditions of passage of the plurality of reluctors are detected by at least two pulse generators; and the at least two pulse generators are arranged so as to detect the passage of a same reluctor at different timings.

13. The reverse rotation preventive device for an engine of a motorcycle according to claim 2, wherein the conditions of passage of the plurality of reluctors are detected by at least two pulse generators; and the at least two pulse generators are arranged so as to detect the passage of a same reluctor at different timings.

14. The reverse rotation preventive device for an engine of a motorcycle according to claim 3, wherein the conditions of passage of the plurality of reluctors are detected by at least two pulse generators; and the at least two pulse generators are arranged so as to detect the passage of a same reluctor at different timings.

15. The reverse rotation preventive device for an engine of a motorcycle according to claim 5, wherein the conditions of passage of the plurality of reluctors are detected by at least two pulse generators; and the at least two pulse generators are arranged so as to detect the passage of a same reluctor at different timings.

16. The reverse rotation preventive device for an engine of a motorcycle according to claim 8, wherein the conditions of passage of the plurality of reluctors are detected by at least two pulse generators; and the at least two pulse generators are arranged so as to detect the passage of a same reluctor at different timings.

17. A reverse rotation preventive device for an engine of a motorcycle comprising:

an ignition device operatively connected to the engine;

a crank pulse rotor having a plurality of reluctors rotated synchronously with a crankshaft of an engine;

pulse generators for outputting a pulse signal corresponding to an interval at which the reluctors are arranged; and reverse rotation preventive means operatively connected to the reverse rotation preventive device for inhibiting ignition at the ignition device by operating a reverse rotation preventive function when an interpulse time of the pulse signal exceeds a predetermined time;

wherein the reverse rotation preventive means cancels the inhibition of the ignition when it is detected that the crankshaft is in normal rotation after the ignition is inhibited by the operation of the reverse rotation preventive function.

18. The reverse rotation preventive device for an engine of a motorcycle according to claim 17, and further comprising:

a stage deciding unit for allocating one revolution of the crankshaft to a plurality of stages on the basis of the crank pulse signal; and measuring means for measuring the interpulse time of the crank pulse signal;

wherein the reverse rotation preventive means includes interpulse time discriminating means for discriminating a plurality of the interpulse times in a predetermined period before passage of a compression top dead center, and crank stage discriminating means for discriminating that a predetermined crank stage has come after the passage of the compression top dead center.

19. The reverse rotation preventive device for an engine of a motorcycle according to claim 17, wherein the reluctors of the crank pulse rotor are arranged at regular intervals, exclusive of a toothless part at one location;

the stage deciding unit makes definite a reference position of the crank pulse rotor on the basis of a crank pulse signal corresponding to passage of the toothless part; and the reverse rotation preventive means cancels the operation of the reverse rotation preventive function so as to permit the ignition when the reference position is made definite and it is decided that the crankshaft is in normal rotation after the ignition at the ignition device is inhibited by the operation of the reverse rotation preventive function.

20. The reverse rotation preventive device for an engine of a motorcycle according to claim 17, wherein as the predetermined time, two kinds of predetermined times are selectively applied according to a time elapsed after arrival of a supply voltage for the reverse rotation preventive device at a predetermined value; and a first predetermined time is applied until the elapsed time reaches a predetermined value, whereas a second predetermined time shorter than the first predetermined time is applied after the elapsed time reaches the predetermined value.

* * * * *